US006427241B1

(12) United States Patent
Manno

(10) Patent No.: US 6,427,241 B1
(45) Date of Patent: Aug. 6, 2002

(54) NECK STRIP FOR HOLDING A HAIR CUTTING CAPE SECURELY AND TRAPPING CUT HAIR AND METHOD OF USING SAME

(76) Inventor: Cristian D. Manno, 850 Palm Ave., #1, Los Angeles, CA (US) 90069

( * ) Notice: Subject to any disclaimer, the term of this patent is extended or adjusted under 35 U.S.C. 154(b) by 0 days.

(21) Appl. No.: 09/537,534

(22) Filed: Mar. 29, 2000

(51) Int. Cl.[7] ..... A41D 27/16
(52) U.S. Cl. ..... 2/60; 2/181
(58) Field of Search ..... 2/181, 50; 428/41.8, 428/42.2, 42.3

(56) References Cited

U.S. PATENT DOCUMENTS

| | | | | |
|---|---|---|---|---|
| 2,882,529 A | | 4/1959 | Argo | |
| 3,214,464 A | | 10/1965 | Lewis | |
| 5,054,124 A | | 10/1991 | Darvas | |
| 5,313,668 A | * | 5/1994 | Bogan et al. | 2/181.4 |
| 5,317,761 A | * | 6/1994 | Piche | 2/181 |
| 5,516,581 A | * | 5/1996 | Kreckel et al. | 428/317.3 |
| 5,953,753 A | | 9/1999 | Perez | |
| 5,996,119 A | | 12/1999 | Anderberg | |

FOREIGN PATENT DOCUMENTS

| | | | | |
|---|---|---|---|---|
| GB | 2220557 A | * | 1/1990 | A41D/3/08 |
| GB | 2237181 A | * | 5/1991 | A41D/13/00 |

* cited by examiner

*Primary Examiner*—John J. Calvert
*Assistant Examiner*—Robert H. Muromoto, Jr.
(74) *Attorney, Agent, or Firm*—Milord Keshishzadeh, Esq; Milord & Associates

(57) ABSTRACT

An elongated and flexible hair cutting strip having a first adhesive surface and a second adhesive for trapping hair clippings during a hair cut. The strip circumscribes the neck of a person such that first adhesive surface attaches to said neck in a secure and flush manner. A collar portion of a hair cutting cape attaches to the second adhesive surface in a secure and flush manner. Accordingly, hair clippings are prevented from entering between the first adhesive surface and the neck of a person and are also prevented from entering between the second adhesive surface and said collar portion of the hair cutting cape. In addition, a plurality of hair cutting strips may be used in combination to enclose the neck of a patron.

16 Claims, 1 Drawing Sheet

NECK STRIP FOR HOLDING A HAIR CUTTING CAPE SECURELY AND TRAPPING CUT HAIR AND METHOD OF USING SAME

FIELD OF THE INVENTION

This invention relates to neck strips for preventing cut hair from penetrating the hair cutting cape and methods therefor, and particularly to a neck strip that has two adhesive surfaces which prevent cut hair from entering the cape and hold the cape in place in a secure fashion.

BACKGROUND OF THE INVENTION

It is known to provide neck strips for sanitary purposes when cutting hair or receiving other hair treatments to prevent the cape from touching the neck of the patron. In addition, neck strips have been unsuccessfully used in an attempt to prevent hair clippings from entering the cape and contacting and discomforting the patron. U.S. Pat. No. 5,996,119 to Anderberg provides a neck strip having adhesive only on opposing ends thereof that need to be in contact with one another to secure the strip in place. Anderberg does not successfully prevent hair clipping from penetrating through the neck because of the gap created by joining the opposing ends and because the body of the strip can be disengaged from the neck.

U.S. Pat. No. 5,054,124 to Darvas provides a hair cutting cape with an adhesive disposed on only one surface of a collar region and pad members with adhesive thereon to bind hair clippings. Darvas requires the user to fold the adhesive portion to create a curve which is physically prohibitive. Furthermore, Darvas does not prevent hair clippings from entering the collar region because of the channel provided therebetween that allows entrance of the hair clippings. Furthermore, in wrapping the cape around the neck of a patron, the shape thereof will become distorted and will cause gaps between the collar region and a neck of the patron through which hair clippings will penetrate.

U.S. Pat. No. 3,213,464 to Lewis provides a disposable apron that necessitates cumbersome installation thereof which does not prevent hair clippings from entering the collar region thereof in a satisfactory manner.

U.S. Pat. No. 2,882,529 to Argo provides a combination neckband and towel that requires the patron to be wearing collared clothing in order for the invention to be utilized. In addition, the invention does not encircle the neck of the patron and thus cannot prevent hair clippings from entering through the neck region of the patron and causing discomfort thereto.

U.S. Pat. No. 5,953,753 to Perez provides a cape for cutting hair that provides a flap which prevents cut hair from clogging the neck closure mechanism. However, Perez's flap allows the entry of hair clippings therethrough to the neck region of a patron. In addition, Perez does not provide a means for preventing entry of hair clippings into the neck region of a user.

The prior art does not address the need for an apparatus that satisfactorily prevents hair clippings from entering the neck region of a patron while providing sanitary attachment of the cape to the patrons' neck region. Therefore, there remains a long standing and continuing need for an advance in the art of sanitary neck strips and methods of use thereof that is simpler in both design and use, is more economical, efficient in its construction and use, and eliminates the failures of the prior art.

SUMMARY OF THE INVENTION

Accordingly, it is a general object of the present invention to overcome the disadvantages of the prior art.

In particular, it is an object of the present invention to provide a neck strip that is effective in preventing cut hair from entering between the hair cutting cape and the neck region of a patron.

It is another object of the present invention to provide a neck strip that has two opposing adhesive surfaces where one surface connects to the neck of a patron and the other surface securely holds a collar portion of a hair cutting cape in place.

It is another object of the present invention to provide hair cutting strip that is easily dispensable.

It is another object of the present invention to provide a neck strip that easily accommodates necks of varying circumference.

It is another object of the present invention to provide a neck strip that is elastic in nature and can be extended to accommodate necks of varying circumference.

It is yet another object of the present invention to provide a neck strip that can be used in combination with another neck strip to accommodate a neck with a very large circumference or when one strip is not long enough to encircle a patron's neck.

It is another object of the present invention to provide a neck strip that is disposable.

It is a further object of the present invention to provide a neck strip that is less costly to manufacture and produce.

In keeping with the principles of the present invention, a unique neck strip for use with a hair cutting cape is presented. The strip has an elongated member with a first adhesive surface and a second adhesive surface disposed on opposing sides thereof. The strip also has a first end and a second end that is distal to said first end. The first adhesive surface is attached to a circumference of a neck of a person and encloses the neck therein. The second adhesive surface then receives a collar portion of hair cutting cape in a secure fashion. Hair clippings are thereby prevented from entering the neck region of a patron because of the elimination of the gap between the collar portion of the cape and the neck of the patron. After the hair cut is complete, the strip having the bound hair thereon can easily be disposed of.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention. In the drawings, wherein similar reference characters denote similar elements throughout the several views.

DETAILED DESCRIPTION OF THE INVENTION

Figure 1:
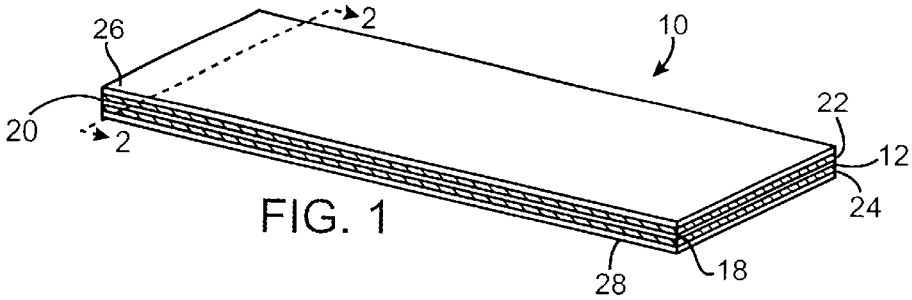
FIG. 1 is a perspective view of the neck strip of the present invention.
Figure 2:
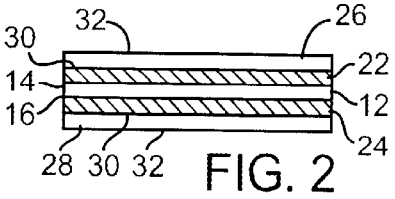
FIG. 2 is a cross sectional view of the neck strip taken along line 2—2 of FIG. 1.

Referring to FIGS. 1 and 2, therein is illustrated a strip apparatus 10 of the present invention. Strip apparatus 10 has a first member 12 that is comprised of a flexible longitudinal material such as, but not limited to, a thin crepe paper, rubber materials, or any polymeric compound. First member 12 is preferably elastic and has a first surface 14 and a second surface 16. First member 12 also has a first end 18 and a second end 20.

A first adhesive material 22 is disposed upon said first surface 14 and a second adhesive material 24 is disposed upon said second surface 16. Adhesive materials 22 and 24 are adapted to attach to various objects and are adapted to be water resistant. In addition, adhesive materials 22 and 24 are made of a chemically inactive material to prevent chemical reactions and irritations of a patron's skin. Adhesive materials 22 and 24 are congruent with first member 12 and are applied to the entire surfaces of first surface 14 and second surface 16 respectively.

A first layer 26 and a second layer 28 are respectively disposed upon and congruent with first adhesive material 22 and second adhesive material 24. Layers 26 and 28 each have a respective first side 30 and a second side 32. Layers 26 and 28 may be comprised of a variety of materials but are preferably made of paper with first side 30 having a waxy compound thereon, or similar compound, to accommodate removal of first side 30 from the respective adhesive materials 22 and 24.

Figure 3:
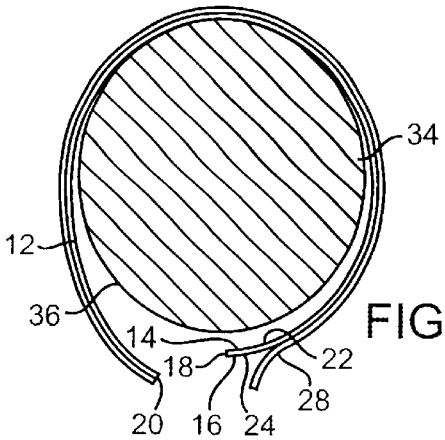
FIG. 3 is a top cross sectional view of a patron's neck illustrating the application of the neck strip.
Figure 4:
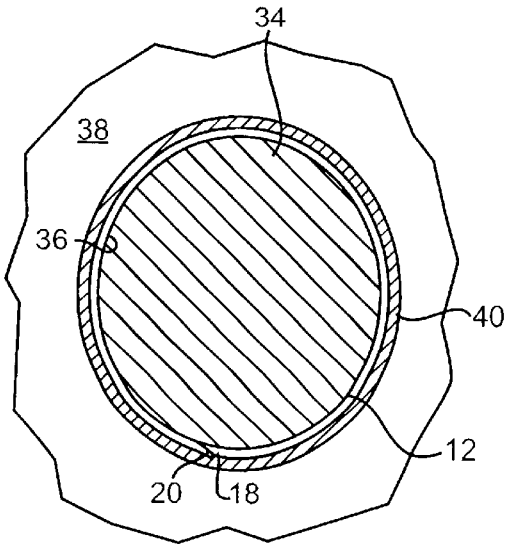
FIG. 4 is a top plan view of a patron's neck with the head not shown illustrating the attachment of the collar portion of a partially illustrated hair cutting cape to the neck strip.

Now also referring to FIGS. 3 and 4, in order to apply strip apparatus 10 to a patron's neck 34 first layer 26 is removed from first adhesive material 22. First adhesive material 22 is applied to outer surface 36 of neck 34 and is extended there around to encircle neck 34 therein such that first end 18 and second end 20 connect with one another. Strip apparatus 10 may be provided in varying lengths to accommodate and circle necks 34 of varying circumferences. After strip apparatus is in place around neck 34, second layer 28 is removed thus exposing second adhesive material 24. A hair cutting cape 38 having a collar region 40 is extended around neck 34 such that collar region 40 thereof is adhered to adhesive material 24 around a circumference thereof.

Figure 5:
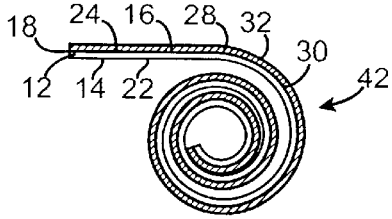
FIG. 5 is an elevational view of a neck strip in a coiled embodiment for dispensation.

Now also referring to FIG. 5, in an alternate embodiment strip apparatus 10 may be provided in a rolled form 42. Second adhesive material 24 will have disposed thereon second layer 28 and will be in contact with first side 30 thereof, which second layer 28 will have said waxy material both on first side 30 and second side 32. In such an embodiment, as first member 12 is rolled around itself, said second side 32 will now be disposed next to first adhesive material 22 and allow the dispensation of first member 12 as first end 18 is pulled. After an appropriate length of strip apparatus 10 is dispensed to encircle neck 34, strip apparatus 10 may be severed in a plurality of fashions as is known in the art. For example, strip apparatus 10 may be cut by scissors or any other sharp object or can be dispensed from a commonly known scotch tape dispenser having a serrated edge for severing strips by application of force.

Figure 6:
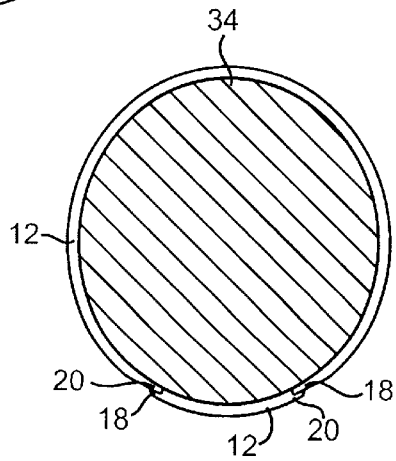
FIG. 6 is a cross sectional view of a patron's neck illustrating the use of two segments of a neck strip to enclose a neck of a patron.

Now also referring to FIG. 6, strip 10 may be used in combination with another strip 10. A first strip 10 is placed around neck 34 but first end 18 and second end 20 do not overlap as previously described. A second strip 10 is cut to a proper length to traverse and interconnect first end 18 and second end 20 of first strip 10.

As a hair cut is received and hair clippings are produced, the binding of second adhesive material 24 to collar region 40 will prevent hair clippings from entering therebetween. In addition, the connection between first adhesive material 22 and outer surface 36 of neck 34 will prevent the penetration of hair clippings therebetween. After a hair cut is finalized, the cape 38 is removed and the strip apparatus 10 may now be removed with the hair clippings attached thereto and discarded. Strip apparatus 10 and components thereof may be obtained from 3M Company located in St. Paul, Minn. The cost-effective production of the neck strip accommodates the disposable nature thereof.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A neck strip apparatus, comprising:

an elongated member having a first surface and a second surface;

at least an adhesive material being disposed upon said first and said second surface;

whereby the elongated member functions without requiring folding thereof.

2. The invention of claim 1, wherein said elongated member is comprised of an elastic material.

3. The invention of claim 1, wherein said elongated member is comprised of paper.

4. The invention of claim 1, wherein said elongated member is comprised of a polymeric compound.

5. The invention of claim 1, wherein said elongated member is comprised of a resinous compound.

6. The invention of claim 1, wherein a plurality of said elongated members are interconnected to enclose a neck of a person.

7. The invention of claim 1, wherein said adhesive material is water resistant.

8. The invention of claim 1, wherein said adhesive material is not chemically active.

9. The invention of claim 1, wherein said adhesive material is capable of binding to itself.

10. The invention of claim 1, wherein said adhesive material is capable of securely yet removably attaching to human skin.

11. The invention of claim 1, wherein said second surface accommodates and binds to a collar portion of a hair cutting cape in a flush fashion.

12. The invention of claim 2 wherein a first layer and a second layer are removably disposed upon said adhesive material of said first and second surface.

13. The invention of claim 2, wherein a layer is removably disposed upon said adhesive material of said second surface of said member such that when first member is encircled upon itself a plurality of times, said layer is also in contact with said adhesive material of said first surface;

whereby, a required length of said member may be dispensed and severed as desired.

14. A strip apparatus used during a hair cut comprising:

an elongated member having a first surface and a second surface;

a first adhesive material applied to said first surface and a second adhesive material applied to said second surface;

a first removable layer being disposed upon said first adhesive material and a second removable layer being disposed upon said second adhesive material;

whereby, said first and second removable layers are easily removed and said first adhesive material is connected to a patrons neck and encloses same therein, and said second adhesive material is connected to a collar region of said cape in a flush fashion without requiring folding of the elongated member.

15. The invention of claim 14, wherein said strip is disposable.

16. A method of using at least a neck strip apparatus during a hair cut, comprising:

providing at least an elongated and flexible member having a first adhesive surface and a second adhesive surface;

extending said member to enclose a neck of a person such that said first adhesive surface is attached thereto in a secure and flush fashion;

extending a collar portion of a hair cutting cape to enclose said second adhesive surface therein in a secure and flush fashion;

whereby the elongated member functions without folding thereof.

* * * * *